United States Patent [19]

Friant

[11] 4,097,046

[45] Jun. 27, 1978

[54] LACROSSE STICK

[76] Inventor: Elias Stewart Friant, Baltimore, Md.

[21] Appl. No.: 766,654

[22] Filed: Feb. 8, 1977

[51] Int. Cl.[2] ..... A63B 59/02

[52] U.S. Cl. ..... 273/96 D

[58] Field of Search ..... 273/96 D, 73 D

[56] References Cited

U.S. PATENT DOCUMENTS

| | | | |
|---|---|---|---|
| 3,664,669 | 5/1972 | Latham et al. | 273/73 D |
| 3,874,667 | 4/1975 | Gallagher et al. | 273/73 D |
| 3,879,036 | 4/1975 | Portz et al. | 273/73 D X |
| 3,910,578 | 10/1975 | Brine | 273/96 D |
| 3,912,267 | 10/1975 | Lyon | 273/73 D |

FOREIGN PATENT DOCUMENTS

| | | | |
|---|---|---|---|
| 424,742 | 2/1935 | United Kingdom | 273/96 D |

*Primary Examiner*—William H. Grieb
*Attorney, Agent, or Firm*—Frederick W. Turnbull

[57] ABSTRACT

A lacrosse stick head in which the lacings of the head are secured to flexible tabs one end of each of which is inserted into the material of the frame of the head.

8 Claims, 10 Drawing Figures

LACROSSE STICK

Lacrosse sticks are provided at one end with a crook, from which the name of the game is derived, or, more recently, with a bow forming a closed frame to which lacings are secured. The lacrosse stick head of the present invention is preferably made of an extruded length of a heat formable, and heat reformable plastic material. The material of the head, however, is not specifically germain to the invention and any other materials that can be formed as required to make the head may be used.

Lacrosse sticks have been traditionally strung by hand using leather, clock cord, gut, synthetic cord, knitted mesh and other materials to form the lacing. The pocket for throwing and catching the ball is formed by interweaving a combination of some of the above materials and attaching the resulting pocket to the frame of the stick through holes drilled into the frame of the head. The pocket is then adjusted by tightening and loosening the proper strings through the holes to obtain the desired playing characteristics — a time consuming procedure and one requiring considerable skill.

Should the frame of the stick or the stringing become damaged, the entire process must be repeated as the damaged material cannot be replaced without destroying the playing characteristics of the stick.

It is an object of the invention to provide a method for securing the pocket material (which may be preformed) into a lacrosse stick so that the pocket material may be installed or removed quickly without changing the adjustment of the pocket material.

It is further object of the invention to increase the impact strength of the head section by eliminating the holes formerly used to string the pocket material into the head. The heat generated by the drilling of holes in known heads causes stresses to be set up at the point where the hole is drilled causing the head of the stick to break almost without exception at one of the holes.

It is a still further object to eliminate the cost of drilling the holes and to eliminate the cost of weaving the pocket material into the head through the holes.

Other and further objects and advantages will appear from the following specification taken with the attached drawing in which like reference characters refer to similar parts in the several views and in which.

Figure 1:
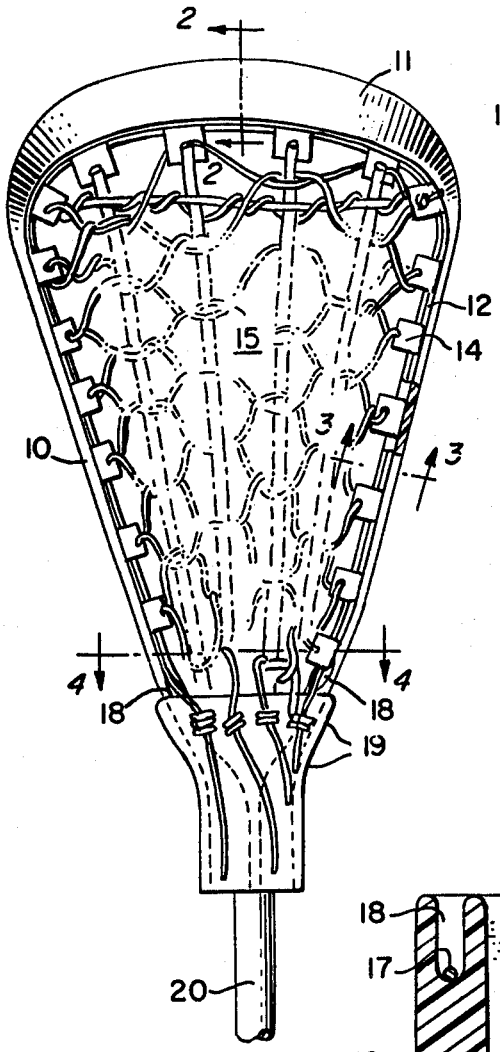
FIG. 1 is a view of the back of the lacrosse stick head of the present invention.

The frame of the present invention seen in FIGS. 1–5 is preferably formed of a length of a strip of generally flat extruded material that is bent into the shape of a lacrosse head having at least one elongated side element 10, and having a portion 11 bent and twisted to form an end portion forming a scoop. The flat material from which this frame is bent has a slot 12 extending along one edge which is narrow at the edge of the strip but is of a larger section interiorly of the strip. The strip may be of any material that is formable into the desired shape, and bendable into a frame, and having strength characteristics adequate for the service.

The slot 12 is provided to retain tab elements 14 to support the ball pocket forming web 15. Elements 14 are shown as tabs to receive the lacing 16 of the ball pocket 15. Tabs 14 are preferably mounted on a length of flexible material 17 which acts both as a means to form an enlargement of tab 14 which may be folded about flexible material or cord 17, so it can not be pulled from slot 12, but also as a means to position tabs 14 along the frame.

Figure 2:
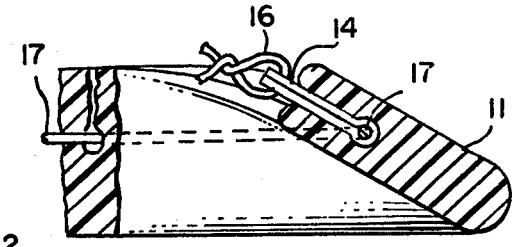
FIG. 2 is a section taken on line 2—2 of FIG. 1.
Figure 3:
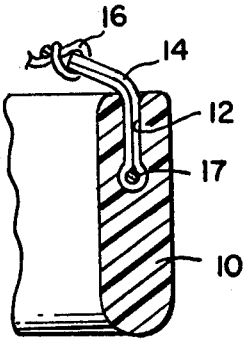
FIG. 3 is a section taken on line 3—3 of FIG. 1.
Figure 4:
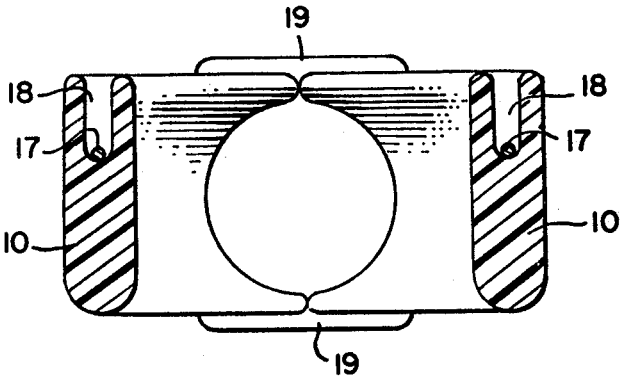
FIG. 4 is a section taken on line 4—4 of FIG. 1.
Figure 5:
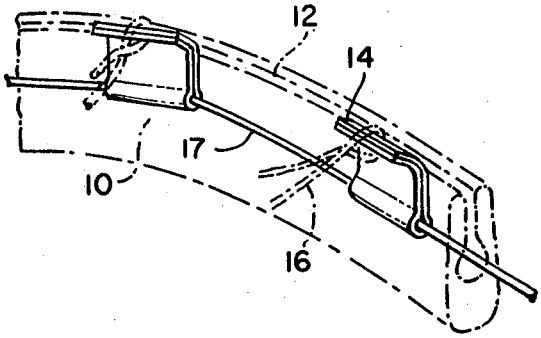
FIG. 5 is a phantom view of a section of the frame showing a plurality of tabs mounted on an elongated flexible element.

From FIGS. 2 and 4 it will be seen that the slots may be opened at selected points 18 so that tabs 14, folded around flexible element 17, which may be a cord or other convenient material, may be inserted in the slot. The flexible element 17 is then used to pull successive tabs 14 along slot 12 so each successive tab 14 is spaced from the neighboring tab the distance determined by the length of element 17 between the tabs. Element 17 is then secured in any known manner such as is presently used to secure the lacings of lacrosse sticks.

It will be noted that elements 14 on cord 17 may be mounted in the frame and, thereafter, the lacings 16 may be added by hand; or the lacings 16, web 15 or other material forming the ball pocket may be assembled with the tabs 14 so that, to lace the lacrosse stick, it is only necessary to position tabs 14 successively in slot 12 and secure the lacing so mounted, in a conventional manner at the handle end of the frame.

If it is intended that the ball pocket will never be relaced, it is seen that after mounting the tabs 14 in slot 12 the entire slot may be closed by heat and pressure, or merely by pressure, depending on the material selected to make the generally flat extruded material, which materials may include aluminum or any of the plastics such as polypropelene, vinyl chloride, and/or elastomers.

The frame of the present invention need not, however, be further deformable after it is formed into its original shape.

The ends of frame portions 10 are formed to closely embrace the stick 20 and a ferrule 19 encircles the ends of the frame. This ferrule may be provided with holes or other means to receive the ends of flexible element 17 or of lacing 15.

Figure 6:
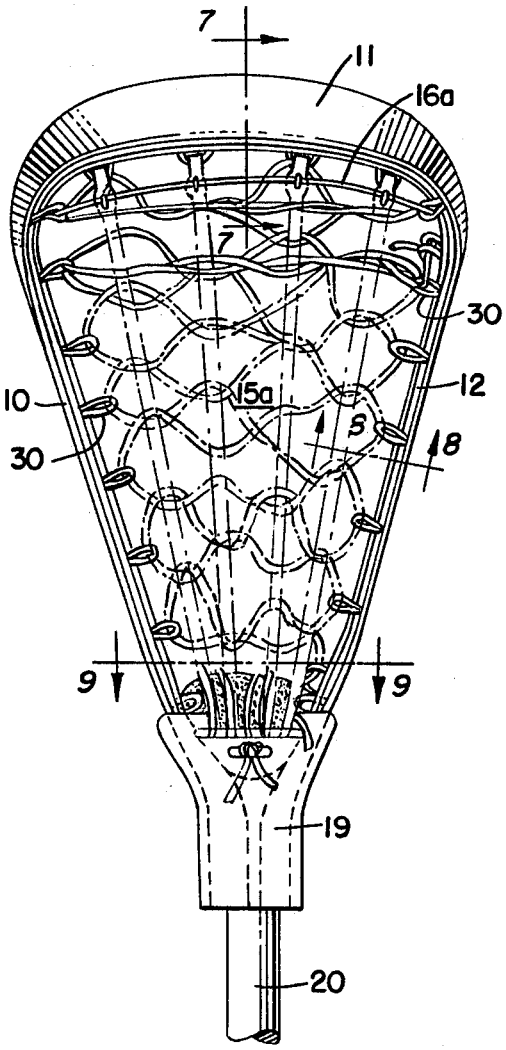
FIG. 6 is a back view of a modifier lacrosse stick head of the present invention.
Figure 7:
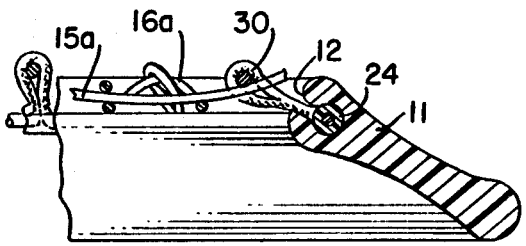
FIG. 7 is a section taken at line 7—7 of FIG. 6.
Figure 8:
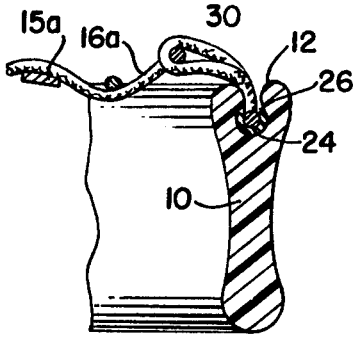
FIG. 8 is a section taken at line 8—8 of FIG. 6.
Figure 9:
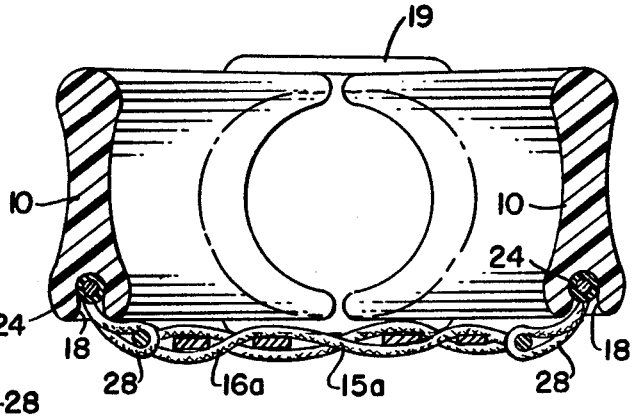
FIG. 9 is a section taken at line 9—9 of FIG. 6.

Referring now to FIGS. 6, 7 8, 9, and 10 the frame material 10, 11 is seen with the slot 12, as shown and described in connection with FIGS. 1–5 inclusive, including the open portions 18 near ferrule 19 as seen in FIGS. 6 and 9 as well as in FIGS. 1 and 4.

In FIGS. 7 to 10 inclusive, however, a plastic tube 24 is provided of a diameter to be pulled axially along the enlarged bottom portion of slot 12, but of too great a diameter to be pulled out of slot 12 except axially through open portions 18 near ferrule 19.

Figure 10:
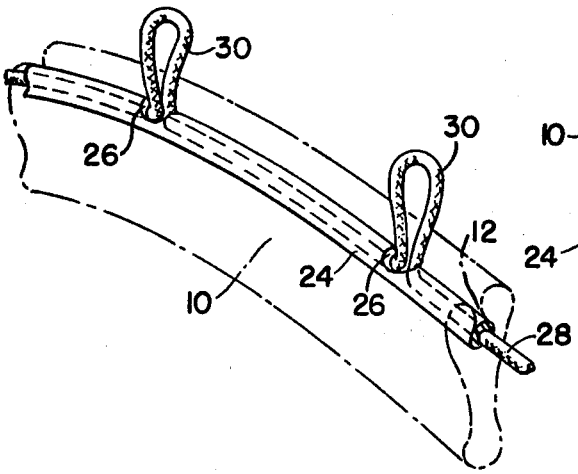
FIG. 10 is a phantom view of a section of the frame showing the modification of FIGS. 6, 7, 8, and 9.

From FIG. 10 it is clearly seen that tube 24 is notched at spaced points 26 by cutting away a portion of one side of the tube 24. An elongated flexible element such as a strong cord or thong 28 is enclosed in tube 24 except where it is pulled out of each notch 26 to form a loop 30 to be used as tabs 14 of FIGS. 1–5 are used to receive lacing 16*a*.

FIGS. 7, 8, 9 and 10 show the web 15*a* laced (16*a*) to loops 30 as web 15 is laced to tabs 14. The ends of cord 28 are secured to ferrule 19 in any conventional manner as flexible element 17 is secured in FIGS. 1-5.

Having thus disclosed my invention I claim:

1. A lacrosse stick head, of the type including a frame and a net forming a ball pocket secured to said frame at spaced points there along, said frame being formed of a length of flat strip material bent to provide at least one elongated side element and an end portion twisted with respect to said side element to form the conventional scoop-shaped end of the frame; the novelty including that said strip of material has a narrow slot extending along the edge of said strip forming the back of said frame and the inner edge of said scoop-shaped end, said slot being narrow at the edge of said frame and having a larger section interiorly of said strip than at its edge, an elongated flexable element carrying means fixed at spaced points there-along to which said net is secured, said elongated flexible element with said means fixed thereto being slideable along said slot with said means extending outwardly through said slot at the edge of said frame, said flexible element being of a diameter greater than said slot at the edge of said frame whereby said means spaced along said frame by said flexible element forms a strong securement for said net on said frame and accurately spaces said means along said frame.

2. The lacrosse stick of claim 1 in which said means to secure said net to said frame includes tabs folded over said flexible element providing at least one end extending outwardly of said slot.

3. The lacrosse stick of claim 1 in which said slot is provided with a limited portion of said slot at the edge of said frame widened to permit insertion of said flexible element, and said means fixed there-along, into said slot to facilitate mounting of said means in said slot.

4. The lacrosse stick of claim 1 in which said means fixed at spaced intervals along said flexible element are loops of said flexible material.

5. The lacrosse stick of claim 1 in which said flexible element is a tube provided with spaced openings along its length and a length of cord extending through said tube, said cord having a portion at each opening in said tube, extending outwardly from said tube to form a loop, said loops constituting said means to which said net is secured.

6. A lacrosse stick comprising a frame and a preformed replaceable pocket, said frame being formed of a length of flat material bent to provide at least one elongated side element and an end portion twisted with respect to said side element to form the conventional scoop-shaped end of said frame, a slot in said length of flat material along the edge forming the back of said frame and the inner edge of said scoop-shaped end, said slot being narrow at the edge of said frame and having a larger section inwardly of said strip than at its edge, said pocket comprising a net shaped to lie within said frame, and a means secured to said pocket to secure said pocket to said frame comprising an elongated flexible element slideable within said larger section of said slot, means mounted on said flexible element to extend outwardly through said narrow section of said slot, a limited portion of said slot being widened to permit passage of said flexible element to facilitate mounting of said pocket in said frame.

7. The lacrosse stick of claim 6 in which said means to secure said net to said frame includes tabs folded over said flexible element providing at least one end extending outwardly of said slot.

8. The lacrosse stick of claim 6 in which said flexible element is a tube provided with spaced openings along its length and a length of cord extending through said tube, said cord having a portion at each opening in said tube extending outwardly from said tube to form a loop, said loops constituting said means to which said net is secured.

* * * * *